US009085431B2

(12) United States Patent
Sawada et al.

(10) Patent No.: US 9,085,431 B2
(45) Date of Patent: Jul. 21, 2015

(54) SHEET FEED CASSETTE

(71) Applicant: Konica Minolta, Inc., Chiyoda-ku (JP)

(72) Inventors: Kenji Sawada, Toyokawa (JP); Kouki Muramoto, Toyohashi (JP); Takahiro Iwasaki, Toyokawa (JP); Masanobu Tomiyasu, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/306,439

(22) Filed: Jun. 17, 2014

(65) Prior Publication Data

US 2014/0367908 A1 Dec. 18, 2014

(30) Foreign Application Priority Data

Jun. 18, 2013 (JP) ..... 2013-127186

(51) Int. Cl.
*B65H 1/12* (2006.01)
*B65H 1/04* (2006.01)

(52) U.S. Cl.
CPC ... *B65H 1/12* (2013.01); *B65H 1/04* (2013.01)

(58) Field of Classification Search
CPC .... B65H 1/12; B65H 1/24; B65H 2405/1116; B65H 2405/11162; B65H 2405/1117; B65H 2405/31; B65H 2405/313
USPC ..... 271/126, 127, 160, 162, 171
See application file for complete search history.

(56) References Cited

U.S. PATENT DOCUMENTS

| | | | | |
|---|---|---|---|---|
| 4,874,159 | A * | 10/1989 | Maeno et al. | 271/171 |
| 5,398,108 | A * | 3/1995 | Morinaga et al. | 399/381 |
| 5,685,535 | A * | 11/1997 | Michel et al. | 271/157 |
| 2006/0113722 | A1* | 6/2006 | Hattori | 271/121 |
| 2008/0001342 | A1* | 1/2008 | Matsushima et al. | 271/3.14 |
| 2008/0237970 | A1* | 10/2008 | Tanaka et al. | 271/109 |
| 2009/0189329 | A1* | 7/2009 | Kaseda | 271/4.1 |
| 2010/0044956 | A1* | 2/2010 | Ko | 271/162 |
| 2010/0172685 | A1* | 7/2010 | Kim et al. | 400/613 |
| 2013/0134657 | A1* | 5/2013 | Nishioka | 271/147 |

FOREIGN PATENT DOCUMENTS

JP 11-116073 A 4/1999

* cited by examiner

*Primary Examiner* — David H Bollinger
(74) *Attorney, Agent, or Firm* — Buchanan Ingersoll & Rooney PC

(57) ABSTRACT

A sheet feed cassette having: a main body to be set in a body of an image forming apparatus; a first press-up member configured to support print media stacked thereon; a first elastic member configured to apply an elastic force to make the first press-up member press up the print media; a second press-up member; a second elastic member configured to apply an elastic force to make the second press-up member press up the first press-up member or the print media; an adjusting mechanism configured to adjust the force of the second press-up member to press up the first press-up member or the print media in accordance with a size of the print media; and a regulatory mechanism configured to prevent the second press-up member from pressing up the first press-up member or the print media when the main body is detached from the body of the image forming apparatus.

8 Claims, 20 Drawing Sheets

SHEET FEED CASSETTE

This application claims benefit of priority to Japanese Patent Application No. 2013-127186 filed on Jun. 18, 2013, the content of which is incorporated herein by reference.

BACKGROUND OF THE INVENTION

1. Field of the Invention

The present invention relates to a sheet feed cassette, and more particularly to a sheet feed cassette that is suited to be used in an image forming apparatus.

2. Description of Related Art

As an invention relating to a conventional sheet feed cassette, for example, an automatic sheet feeder disclosed by Japanese Patent Laid-Open Publication No. H11-116073 is known. The automatic sheet feeder comprises a stacker plate, an auxiliary press-up plate, a first coil spring, a second coil spring and a feed roller. A plurality of sheets are stacked on the stacker plate. The first coil spring presses up the stacker plate, whereby the leading edge of the stacked sheets is pressed against the feed roller. The auxiliary press-up plate is located below the stacker plate, and the second coil spring presses up the auxiliary press-up plate, whereby the stacker plate is pressed up.

In the automatic sheet feeder, when sheets to be fed are long in a sheet feeding direction, the auxiliary press-up plate presses up the stacker plate. On the other hand, when sheets to be fed are short in the sheet feeding direction, the auxiliary press-up plate does not come in contact with the stacker plate. Therefore, when sheets to be fed are long and accordingly heavy, the sheets are lifted up by a relatively great force, and when sheets to be fed are short and accordingly light, the sheets are lifted up by a relatively small force. Consequently, the force to press the leading edge of the stacked sheets against the feed roller is almost constant regardless of the size of the stacked sheets. Thus, in the automatic sheet feeder disclosed by Japanese Patent Laid-Open Publication No. H11-116073, sheet feeding errors can be reduced.

In the automatic sheet feeder disclosed by Japanese Patent Laid-Open Publication No. H11-116073, however, in stacking sheets on the stacker plate, a great force is necessary to press down the stacker plate. More specifically, in stacking a large number of sheets in the automatic sheet feeder, a user needs to set the sheets on the stacker plate and thereafter press down the stacker plate. In this way, the sheets are loaded in the automatic sheet feeder. However, when heavy sheets are set, the stacker plate is pressed up by the auxiliary press-up plate, and in this case, the user needs to press down the stacker plate against the elastic force of the first coil and the elastic force of the second coil. Therefore, in the automatic sheet feeder disclosed by Japanese Patent Laid-Open Publication No. H11-116073, in stacking sheets on the stacker plate, a user needs to apply a great force to press down the stacker plate.

SUMMARY OF THE INVENTION

An object of the present invention is to provide a sheet feed cassette wherein a press-up plate can be pressed down by a small force.

A sheet feed cassette according to an embodiment of the present invention comprises: a main body to be set in a body of an image forming apparatus; a first press-up member provided on a bottom surface of the main body and configured to support a plurality of print media stacked thereon; a first elastic member configured to apply an elastic force to the first press-up member such that the first press-up member presses up a downstream end, with respect to a feeding direction, of the plurality of print media; a second press-up member; a second elastic member configured to apply an elastic force to the second press-up member such that the second press-up member presses up the first press-up member or the plurality of print media; an adjusting mechanism configured to adjust the force of the second press-up member to press up the first press-up member or the plurality of print media in accordance with a size of the print media; and a regulatory mechanism configured to prevent the second press-up member from pressing up the first press-up member or the plurality of print media when the main body is detached from the body of the image forming apparatus.

DETAILED DESCRIPTION OF THE PREFERRED EMBODIMENTS

An image forming apparatus comprising a sheet feed cassette according to an embodiment of the present invention is described with reference to the drawings.

Structure of the Image Forming Apparatus

Figure 1:
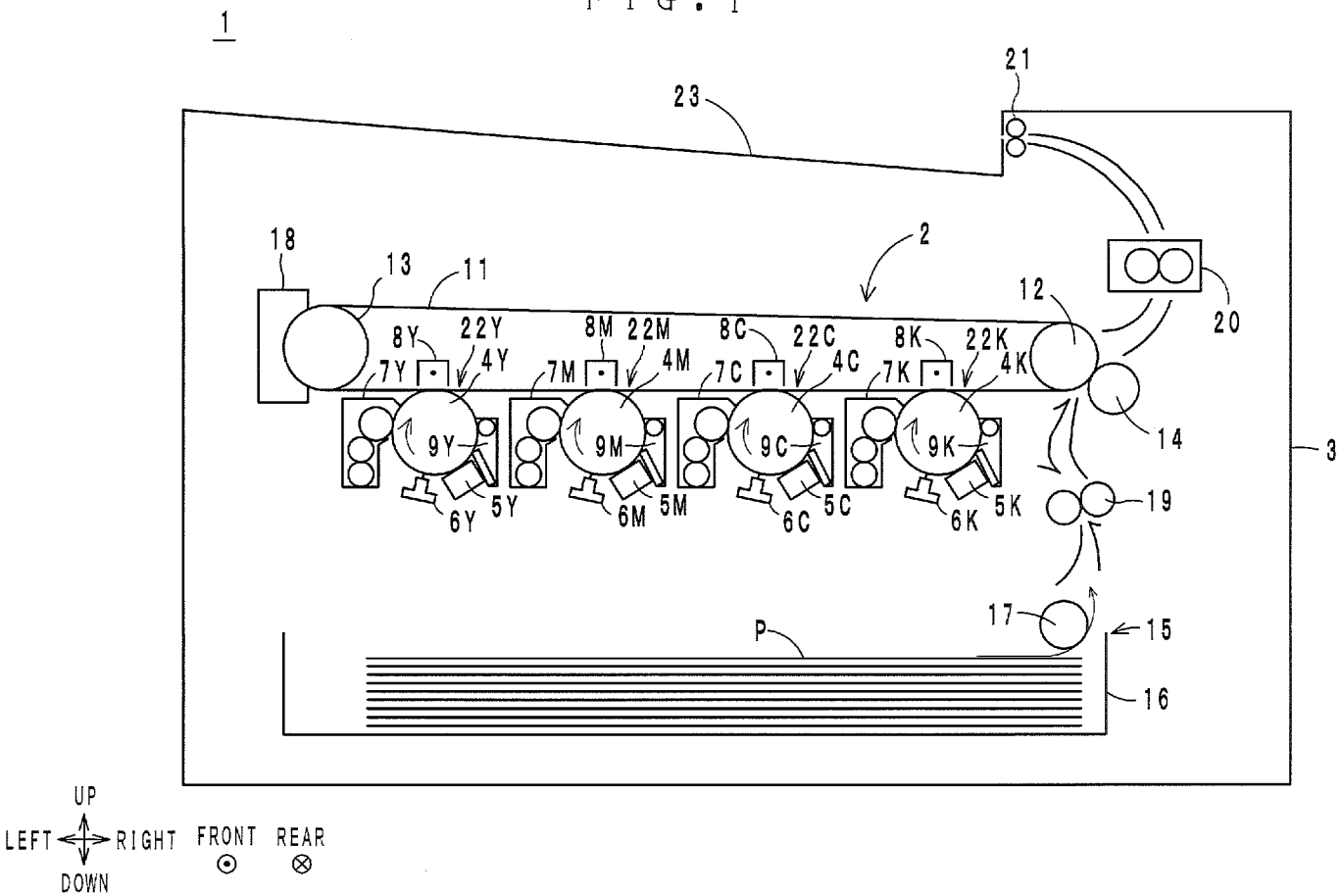
FIG. 1 is a view showing the overall structure of an image forming apparatus.

FIG. 1 shows the overall structure of an image forming apparatus 1 comprising a sheet feed cassette according to an embodiment of the present invention. The right-left direction on the paper of FIG. 1 is referred to merely as a right-left direction, the front-rear direction on the paper of FIG. 1 is referred to merely as a front-rear direction, and the up-down direction on the paper of FIG. 1 is referred to merely as an up-down direction.

The image forming apparatus 1 is an electrophotographic color printer configured to form and combine images in four colors, namely, Y (yellow), M (magenta), C (cyan) and K (black) by a tandem method. However, the image forming apparatus 1 may be a monochromatic image forming apparatus or an ink-jet type image forming apparatus. The image forming apparatus 1 is operable to form an image on a sheet (print medium) in accordance with image data read by a scanner. The image forming apparatus 1, as shown by FIG. 1, comprises a printing section 2, a body 3, a sheet feed cassette 15, a pair of timing rollers 19, a fixing device 20, a pair of ejection rollers 21, and a printed-sheet tray 23.

The body 3 is a housing of the image forming apparatus 1, and houses the printing section 2, the sheet feed cassette 15, the pair of timing rollers 19, the fixing device 20 and the pair of ejection rollers 21.

The sheet feed cassette 15 feeds sheets one by one, and comprises generally a sheet tray 16 and a feed roller 17. On the sheet tray 16, a plurality of sheets to be subjected to printing are stacked. The feed roller 17 feeds the stack of sheets one by one from the sheet tray 16. The pair of timing rollers 19 feeds a sheet to the printing section 2 with proper timing for secondary transfer, that is, so that a toner image can be transferred to the sheet properly. The sheet feed cassette 15 will be described in detail later.

The printing section 2 forms a toner image on a sheet fed from the sheet feed cassette 15. The printing section 2 comprises image forming units 22Y, 22M, 22C and 22K, optical scanning devices 6Y, 6M, 6C and 6K, transfer devices 8Y, 8M, 8C and 8K, an intermediate transfer belt 11, a driving roller 12, a driven roller 13, a secondary transfer roller 14, and a cleaning device 18. The image forming units 22Y, 22M, 22C and 22K comprise photoreceptor drums 4Y, 4M, 4C and 4K, chargers 5Y, 5M, 5C and 5K, developing devices 7Y, 7M, 7C and 7K, and cleaners 9Y, 9M, 9C and 9K, respectively.

The photoreceptor drums 4Y, 4M, 4C and 4K are located inside the body 3 and are cylindrical. The photoreceptor drums 4Y, 4M, 4C and 4K are rotated clockwise in FIG. 1. The chargers 5Y, 5M, 5C and 5K charge the peripheral surfaces of the photoreceptor drums 4Y, 4M, 4C and 4K, respectively. The optical scanning devices 6Y, 6M, GC and 6K are controlled by a CPU (not shown) to scan the peripheral surfaces of the photoreceptor drums 4Y, 4M, 4C and 4K with beams BY, BM, BC and BK, respectively. Thereby, electrostatic latent images are formed on the photoreceptor drums 4Y, 4M, 4C and 4K.

The developing devices 7Y, 7M, 7C and 7K are located inside the body 3, and supply toner to the photoreceptor drums 4Y, 4M, 4C and 4K, respectively, to develop the electrostatic latent images into toner images.

The intermediate transfer belt 11 is stretched between the driving roller 12 and the driven roller 13. The toner images formed on the photoreceptor drums 4Y, 4M, 4C and 4K are transferred to the intermediate transfer belt 11 and are combined to become a composite toner image (primary transfer). The transfer devices 8Y, 8M, 8C and 8K are located to face the inner surface of the intermediate transfer belt 11, and operate for the primary transfer of the toner images from the photoreceptor drums 4Y, 4M, 4C and 4K to the intermediate transfer belt 11. After the primary transfer, the cleaners 9Y, 9M, 9C and 9K remove residual toner from the peripheral surfaces of the photoreceptor drums 4Y, 4M, 4C and 4K, respectively. The driving roller 12 is driven by an intermediate transfer belt driver (not shown in FIG. 1) to rotate the intermediate transfer belt 11 counterclockwise. Thereby, the intermediate transfer belt 11 carries the composite toner image to the secondary transfer roller 14.

The secondary transfer roller 14, which is in the shape of a drum, is opposed to the intermediate transfer belt 11. When a transfer voltage is applied to the secondary transfer roller 14, the secondary transfer roller 14 operates to transfer the toner image carried by the intermediate transfer belt 11 to a sheet passing through between the intermediate transfer belt 11 and the secondary transfer roller 14 (secondary transfer). After the secondary transfer of the toner image to the sheet, the cleaning device 18 removes residual toner from the intermediate transfer belt 11.

The sheet after obtaining a toner image thereon by the secondary transfer is fed to the fixing device 20. The fixing device 20 applies a heating treatment and a pressing treatment to the sheet to fix the toner image on the sheet.

The sheet P after passing through the fixing device 20 is ejected onto the printed-sheet tray 23 through the pair of ejection rollers 21. On the printed-sheet tray 23, printed sheets P are stacked.

Structure of the Sheet Feed Cassette

Figure 2:
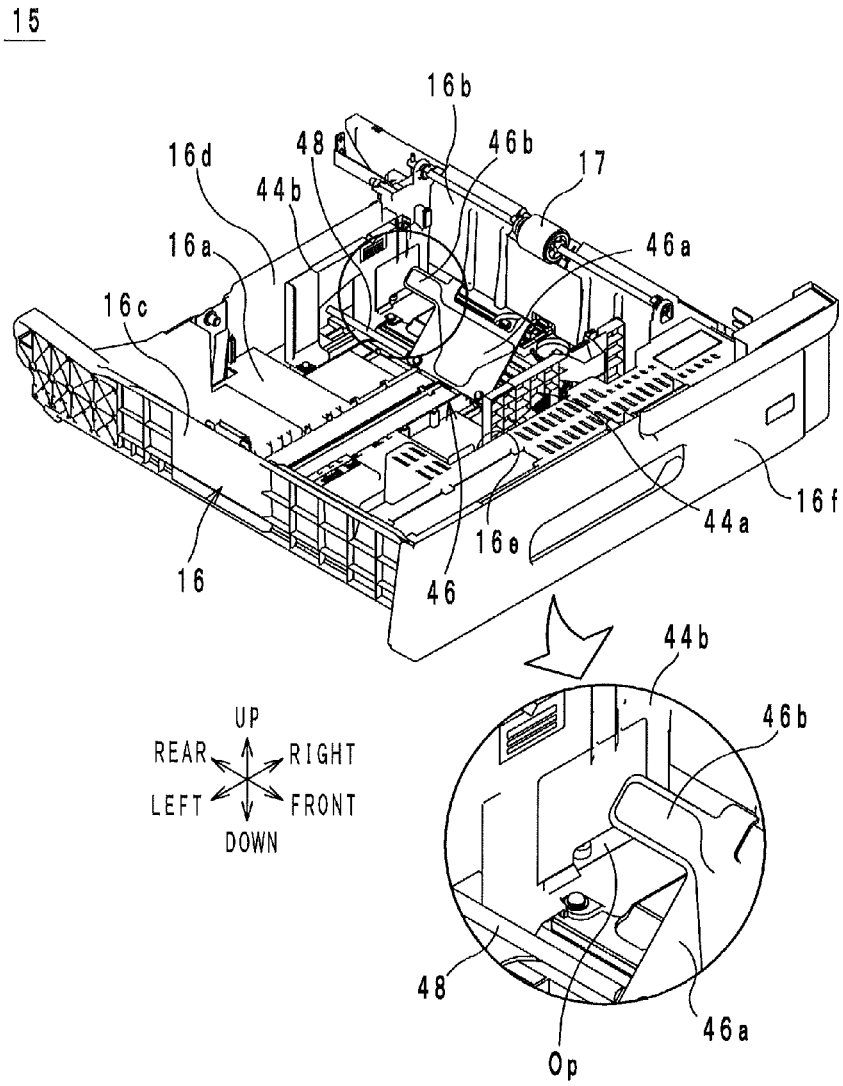
FIG. 2 is a perspective view of a sheet feed cassette.
Figure 3:
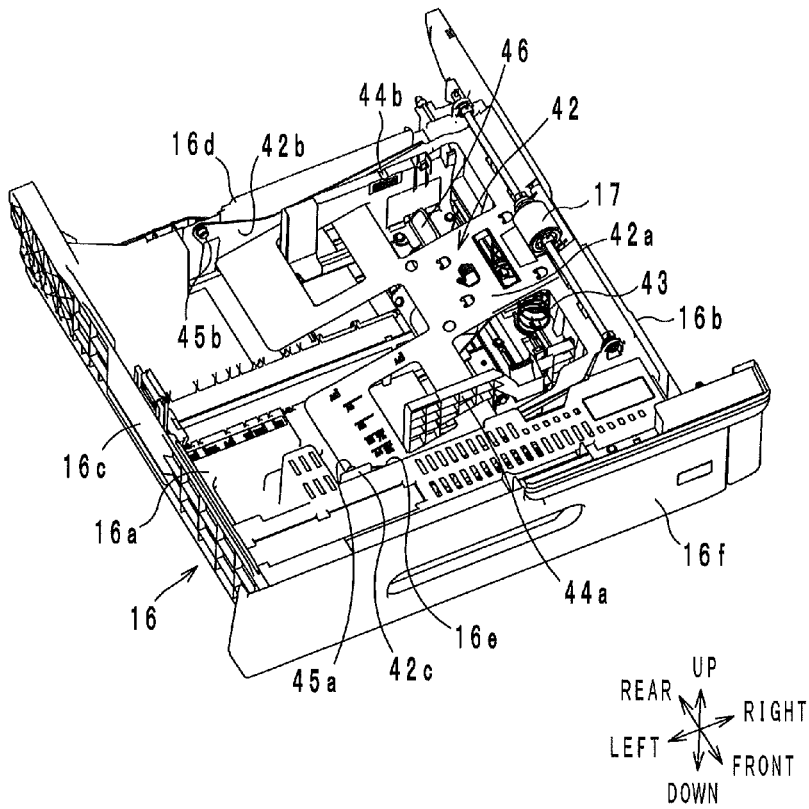
FIG. 3 is a perspective view of the sheet feed cassette.
Figure 4:
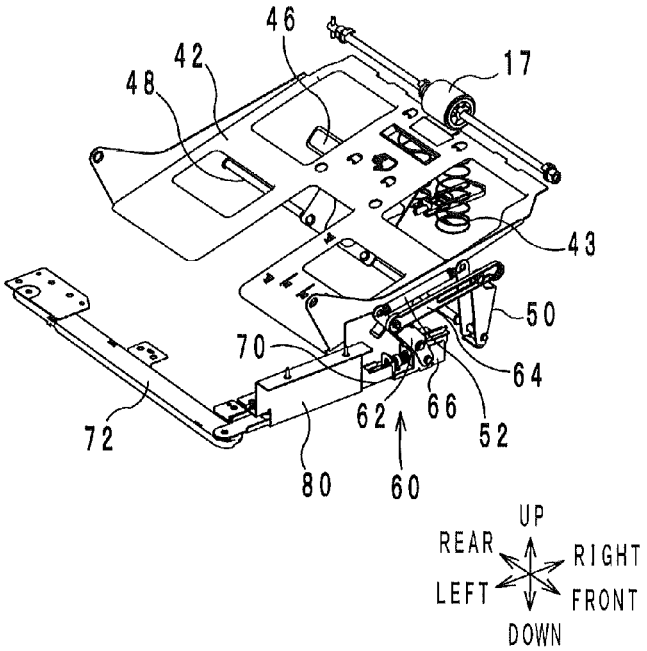
FIG. 4 is a perspective view of the sheet feed cassette shown by FIG. 3 from which a sheet tray is omitted.
Figure 5:
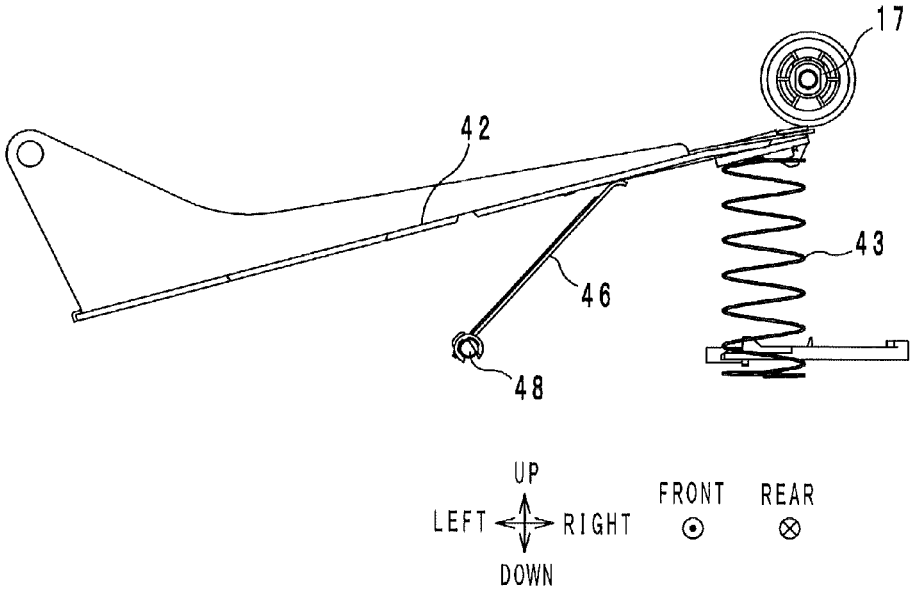
FIG. 5 is a front view of a press-up plate and an auxiliary press-up plate of the sheet feed cassette in a state shown by FIG. 4.
Figure 6:
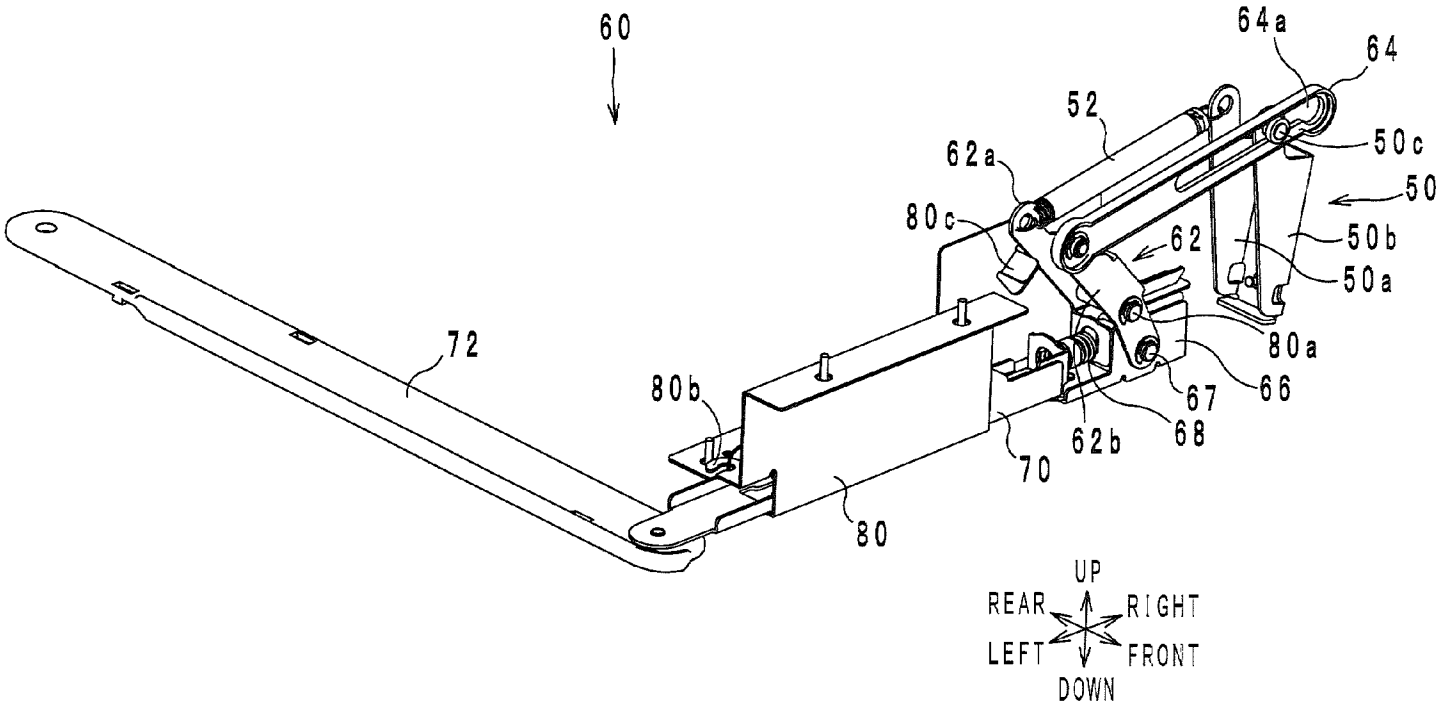
FIG. 6 is a perspective view of a regulatory mechanism of the sheet feed cassette.
Figure 7:
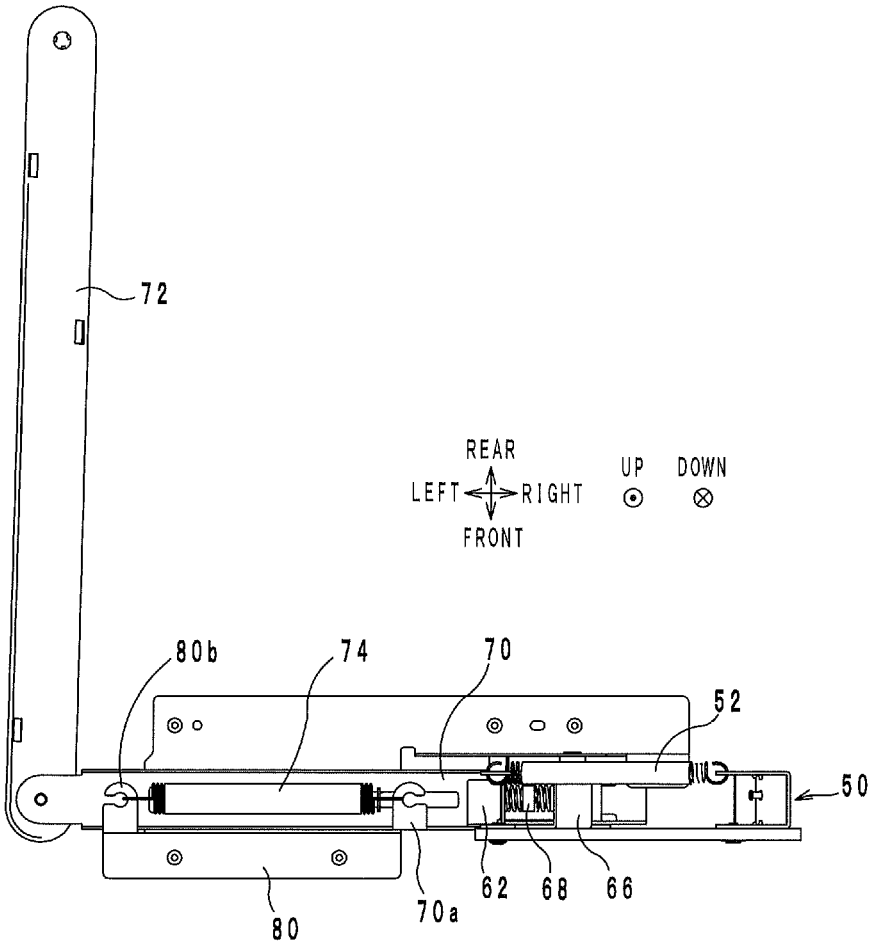
FIG. 7 is a top view of the regulatory mechanism.
Figure 8:
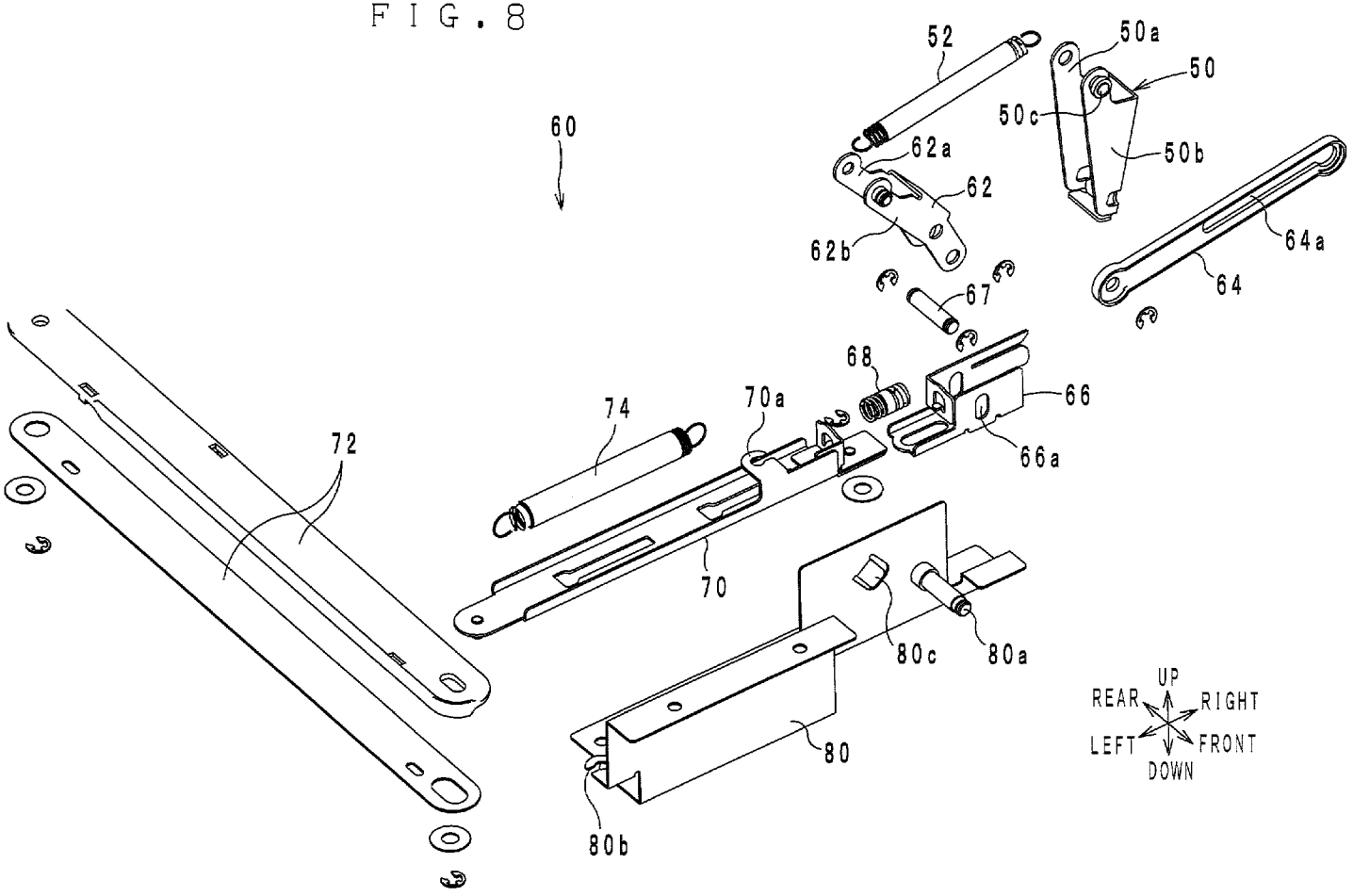
FIG. 8 is an exploded perspective view of the regulatory mechanism.

The structure of the sheet feed cassette 15 is described with reference to the drawings. FIGS. 2 and 3 are perspective views of the sheet feed cassette 15. FIGS. 2 and 3 show the sheet feed cassette 15 in a state where sheets having a relatively large width (for example, A3-sized sheets) are set therein. In FIG. 2, a press-up plate 42 is not shown. FIG. 4 is a perspective view of the sheet feed cassette 15 shown by FIG. 3, but the sheet tray 16 is not shown in FIG. 4. FIG. 5 is a front view of the press-up plate 42 and an auxiliary press-up plate 46 of the sheet feed cassette 15. FIG. 6 is a perspective view of a regulatory mechanism 60 of the sheet feed cassette 15. FIG. 7 is a top view of the regulatory mechanism 60. FIG. 8 is an exploded perspective view of the regulatory mechanism 60. The sheet P is fed to right. In the following, therefore, the right-left direction is also referred to as a sheet feeding direction, and the front-rear direction is also referred to as a sheet widthwise direction.

The sheet feed cassette 15 is inserted in the lower section of the body 3 of the image forming apparatus 1 from the front side, and the sheet feed cassette 15 is detachable from the body 3. The sheet feed cassette 15, as shown by FIGS. 2 through 8, comprises a sheet tray 16, a feed roller 17, a press-up plate 42, coil springs 43, regulating members 44*a* and 44*b*, pins 45*a* and 45*b*, an auxiliary press-up plate 46, a shaft 48, a lever 50, a coil spring 52, and a regulatory mechanism 60.

The sheet tray 16 is, as shown by FIG. 3, a body of the sheet feed cassette 15. The sheet tray 16 is a box in the shape of a rectangular parallelepiped with an open top. The sheet tray 16 is to be set in the body 3. The sheet tray 16 comprises a bottom surface 16*a*, a right side 16*b*, a left side 16*c*, a rear side 16*d*, a front side 16*e*, and a panel 16*f*. The panel 16*f* is located in front of the front side 16*e* at a certain interval. A handle is provided on the panel 16*f* to permit a user to draw the sheet feed cassette 15.

The feed roller 17 is a cylindrical roller located above the right side 16*b*, in the center of the right side with respect to the front-rear direction. The feed roller 17 is supported by a shaft, and the roller and the shaft can be rotated in an integrated manner by a motor (not shown).

As shown in FIGS. 3 through 5, the press-up plate 42 is provided on the bottom surface 16*a* of the sheet tray 16. The press-up plate 42 is made by bending a metal plate, for example. The press-up plate 42 comprises a body 42*a*, and bent portions 42*b* and 42*c*. The body 42*a* is rectangular and is located on the bottom surface 16*a*. Further, the body 42*a* has an opening to allow attachment of the regulating members 44*a* and 44*b* as will be described later. The bent portion 42*b* is bent upward from the rear side of the body 42*a*. Accordingly, the bent portion 42*b* is opposed to the rear side 16*d*. The bent portion 42*c* is bent upward from the front side of the body 42*a*. Accordingly, the bent portion 42*c* is opposed to the front side 16*e*.

The pin 45*a* projects from the front side 16*e* toward the rear side and pierces the bent portion 42*c*, near the left end. The pin 45*b* projects from the rear side 16*d* toward the front side and pierces the bent portion 42*b*, near the left end. Accordingly, the press-up plate 42 is attached to the sheet tray 16 to be capable of rotating on the pins 45*a* and 45*b*, which are located near the left end of the press-up plate 42, relative to the sheet tray 16.

As shown in FIGS. 3 through 5, the coil springs 43 are elastic members applying an elastic force to the press-up plate 42 so that the press-up plate 42 presses up the right side (the downstream end in the sheet feeding direction) of the stack of sheets P. The coil springs 43 are located between the bottom surface 16*a* of the sheet tray 16 and the body 42*a* of the press-up plate 42, under the feed roller 17. In this embodiment, two coil springs 43 are provided.

The regulating members 44*a* and 44*b* are movable in the sheet widthwise direction (i.e., the front-rear direction), and the regulating members 44*a* and 44*b* are to prevent the sheets P from moving in the widthwise direction. As shown in FIGS. 2 and 3, the regulating members 44*a* and 44*b* are plate-like members having vertical surfaces opposed to each other in the front-rear direction. The regulating members 44*a* and 44*b* are attached to the bottom surface 16*a* of the sheet tray 16 through the opening made in the body 42*a* of the press-up plate 42. With a rack-and-pinion mechanism (not shown), the regulating members 44*a* and 44*b* are capable of sliding in the opposite direction to each other in an interlocked manner. The regulating member 44*b* has an opening Op near the lower end.

As shown in FIGS. 2 through 5, the auxiliary press-up plate 46 is located between the bottom surface 16*a* of the sheet tray 16 and the body 42*a* of the press-up plate 42. The auxiliary press-up plate 46 is made by bending a metal plate, for example. The auxiliary press-up plate 46 comprises a body 46*a* and a tag 46*b*. The body 46*a* is rectangular. The tag 46*b* protrudes from the right rear corner of the body 46*a* toward the rear side.

The shaft 48, as shown in FIGS. 2 and 4, extends in the sheet widthwise direction (in the front-rear direction) to pierce the rear side 16*d* and the front side 16*e*. The left end of the body 46*a* of the auxiliary press-up roller 46 is connected to the shaft 48, in the center with respect to the front-rear direction. Accordingly, the auxiliary press-up plate 46 is supported by the shaft 48 to be capable of rotating relative to the sheet tray 16. In other words, when the shaft 48 is rotated, the auxiliary plate 46 is rotated together with the shaft 48.

The lever 50, as shown by FIGS. 4 and 6, comprises two triangular plates 50*a* and 50*b* located between the front side 16*e* and the panel 16*f*. The triangular plates 50*a* and 50*b* have substantially the same shape and lie on top of each other when viewed from the front side. The triangular plates 50*a* and 50*b* are connected to each other. The lower end of the lever 50 is connected to the front end of the shaft 48. Accordingly, the auxiliary press-up plate 46 and the lever 50 are supported by the shaft 48 to be capable of rotating on the shaft 48.

The regulatory mechanism 60 is located on the bottom surface 16*a*, in the space between the front side 16*e* and the panel 16*f*, and under the left side 16*c*. The coil spring 52 is a tension spring. A first end of the coil spring 52 is connected to the upper end of the triangular plate 50*a* of the lever 50. A second end of the coil spring 52 is connected to the regulatory mechanism 60. The coil spring 52 pulls the lever 50 to tilt the lever 50 to the left. Thereby, a force to rotate the auxiliary plate 46 counterclockwise on the shaft 48 is applied. Accordingly, the right side of the body 46*a* of the auxiliary press-up plate 46 presses up the press-up plate 42. In this way, the coil spring 52 applies an elastic force to the auxiliary press-up plate 46 such that the press-up plate 46 presses up the press-up plate 42. The regulatory mechanism 60 prevents the auxiliary press-up plate 46 from pressing up the press-up plate 42 when the sheet tray 16 is detached from the body 3. The regulatory mechanism 60 will be described in more detail later.

In the sheet feed cassette 15, the force of the press-up plate 42 to press up the sheets P is adjustable in accordance with the width (size) of the sheets P. More specifically, the force of the auxiliary press-up plate 46 to press the press-up plate 42 changes in accordance with the positions of the regulating members 44*a* and 44*b*. When the stacked sheets P have a relatively small width (size), the interval between the regulating members 44*a* and 44*b* is small, and accordingly, the force of the press-up plate 42 to press up the sheets P is relatively small. On the other hand, when the stacked sheets P have a relatively large width (size), the interval between the regulating members 44*a* and 44*b* is large, and accordingly the force of the press-up plate 42 to press up the sheets P is relatively great. Thus, the regulating members 44*a* and 44*b* function as an adjusting mechanism to adjust the force of the auxiliary press-up plate 46 to press up the press-up plate 42 in accordance with the width of the sheets P. The details will be described below with reference to the drawings.

Figure 9:
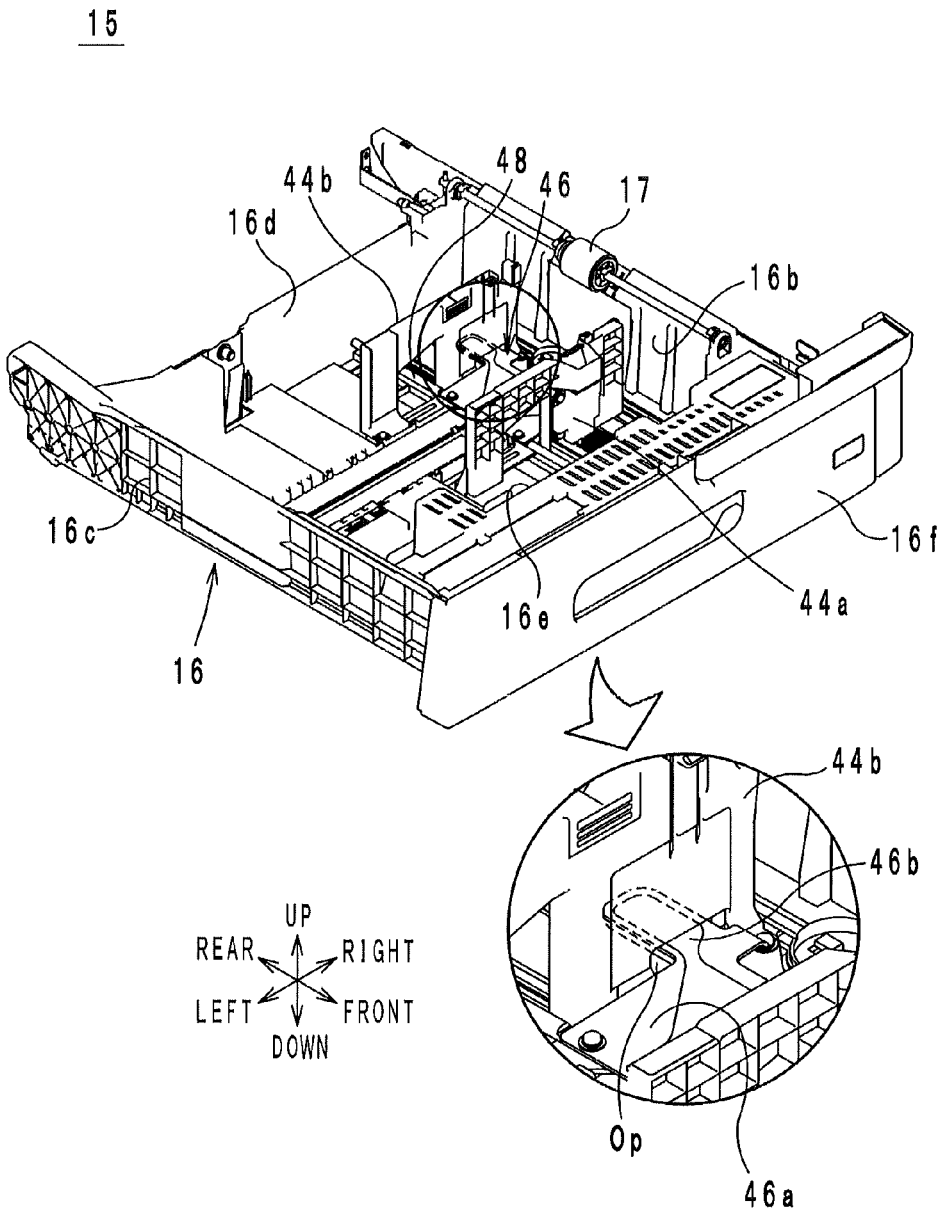
FIG. 9 is a perspective view of the sheet feed cassette.
Figure 10:
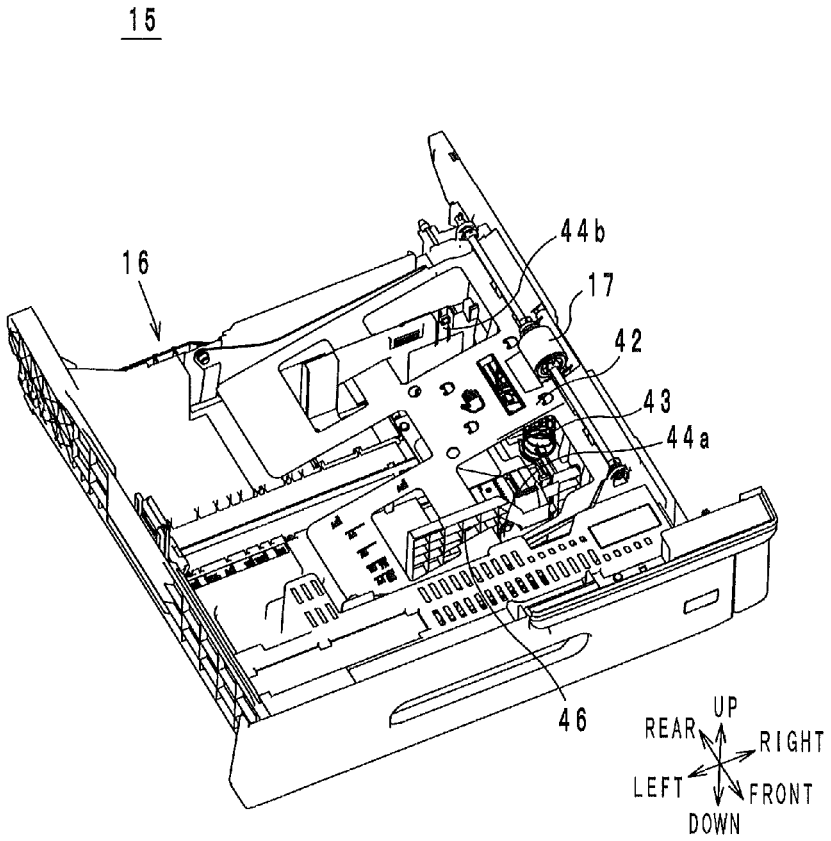
FIG. 10 is a perspective view of the sheet feed cassette.
Figure 11:
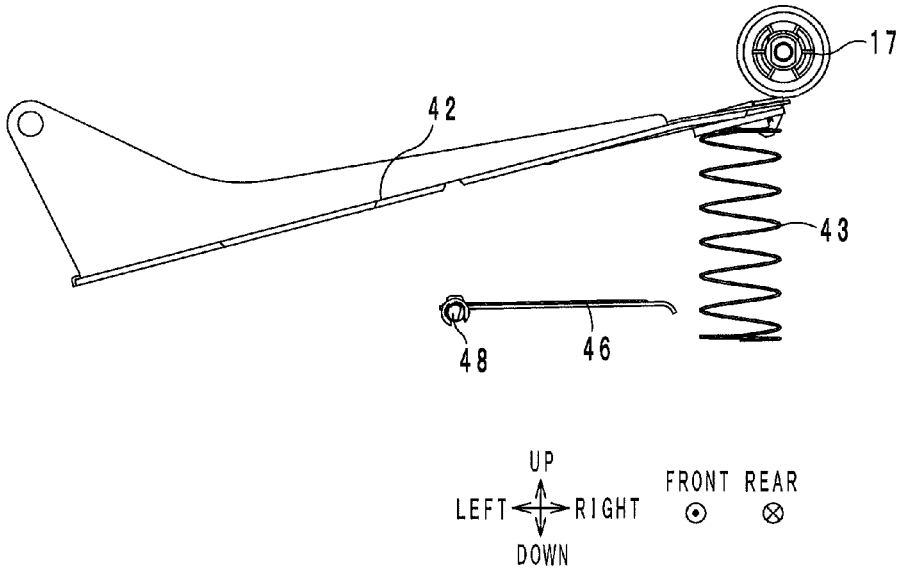
FIG. 11 is a front view of the press-up plate and the auxiliary press-up plate of the sheet feed cassette in a state shown by FIG. 9.

FIGS. 9 and 10 are perspective views of the sheet feed cassette 15. FIG. 9 shows the sheet feed cassette 15 when sheets having a relatively small width (for example, sheets of a postcard size) are to be stacked in the cassette 15. The press-up plate 42 is omitted from FIG. 9. FIG. 11 is a front view of the press-up plate 42 and the auxiliary press-up plate 46 of the sheet feed cassette 15 in the state shown by FIG. 10.

When sheets having a relatively small width (size) are stacked on the press-up plate 42, as shown in FIG. 9, the interval between the regulating members 44*a* and 44*b* is small. Then, the tag 46*b* of the auxiliary press-up plate 46 comes in the opening Op of the regulating member 44*b*, that is, the opening Op and the tag 46*b* come in engagement with each other. In this state, as shown in FIGS. 9 and 11, the regulating member 44*b* keeps the auxiliary press-up plate 46 from coming in contact with the press-up plate 42. Accordingly, the sheets P (not shown) stacked on the press-up plate 42 are pressed up only by the force of the coil spring 43 to press up the press-up plate 42. Thus, in this state, the sheets P are pressed up by a relatively small force.

When sheets having a relatively large width (size) are stacked on the press-up plate 42, as shown in FIGS. 2 and 3, the interval between the regulating members 44*a* and 44*b* is large. In this state, the tag 46*b* of the auxiliary press-up plate 46 does not come in the opening Op of the regulating member 44*b*, that is, the opening Op and the tag 46*b* do not engage with each other. The regulating member 44*b* allows the auxiliary press-up plate 46 to come in contact with the press-up plate 42. Thereby, the auxiliary press-up plate 46 presses up the press-up plate 42. Accordingly, the sheets P (not shown) stacked on the press-up plate 42 are pressed up by the force of the coil spring 43 to press up the press-up plate 42 and the force of the coil spring 52 to press up the auxiliary press-up plate 46. Thus, in this state, the sheets P are pressed up by a relatively great force.

Next, the regulatory mechanism 60 will be described in more detail with reference to FIGS. 4 and 6 through 8. The regulatory mechanism 60 prevents the auxiliary press-up plate 46 from pressing up the press-up plate 42 when the sheet tray 16 is detached from the body 3. The regulatory mechanism 60, as shown in FIGS. 6 through 8, comprises a lever 62, a link 64, a slider 66, a coil spring 68, a slider 70, a lever 72 and a coil spring 74.

A base 80 is provided on the bottom surface 16*a* of the sheet tray 16. The base 80 is a part of the sheet tray 16 and extends in the right-left direction. Near the right end of the base 80, a pin 80*a* is provided to project to the front. Near the left end of the base 80, a hook 80*b* is provided. Further, a projection 80*c* is provided on the base 80, at the upper left side of the pin 80*a*. The projection 80*c* is a part of the regulatory mechanism 60.

The lever 62, as shown in FIG. 8, comprises two plates 62*a* and 62*b* extending in the up-down direction, and is located at the left side of the lever 50. The plates 62*a* and 62*b* have substantially the same shape and lie on top of each other when viewed from the front side. The plates 62*a* and 62*b* are connected to each other. The pin 80*a* pierces the lever 62, in the center with respect to the lengthwise direction. Thereby, the lever 62 is attached to the base 80 to be capable of rotating on the base 80. Further, the second end of the coil spring 52 is connected to the upper end of the plate 62*a*.

The link 64 is a stick-like member extending in the right-left direction. In the right half of the link 64, a long hole 64*a* is made. A first end of the link 64 is connected to the upper end of the triangular plate 50*b*. More specifically, a pin 50*c* is provided at the upper end of the triangular plate 50*b*, and the pin 50*c* is inserted in the long hole 64*a* of the link 64. Accordingly, the pin 50*c* is capable of sliding within the long hole 64*a*. A second end of the link 64 is connected to the upper end of the plate 62*b*. This arrangement of the link 64 restricts movements of the levers 50 and 62 such that the portion of the lever 50 where the first end of the coil spring 52 is connected (the upper end of the plate 50*a*) and the portion of the lever 62 where the second end of the coil spring 52 is connected (the upper end of the plate 62*a*) will not come within a specified distance (natural length of the coil spring 52). Thereby, the levers 50 and 62 are prevented from coming too close to each other, and the coil spring 52 is prevented from bending.

The slider 66 is located below the lever 62 to be capable of sliding in the right-left direction along the base 80. The lower end of the lever 62 is connected to the slider 66. More specifically, a long hole 66*a* extending in the up-down direction is made in the slider 66. At a lower portion of the lever 62, a pin 67 extending in the front-rear direction is provided. The pin 67 is inserted in the long hole 66*a*. Accordingly, the pin 67 is capable of sliding up and down within the long hole 66*a*. Consequently, when the slider 66 slides leftward, the pin 67 slides leftward together with the slider 66, and the lever 62 is rotated clockwise. On the other hand, when the slider 66 slides rightward, the pin 67 slides rightward together with the slider 66, and the lever 62 is rotated counterclockwise.

The slider 70 is located at the left side of the slider 66, and is capable of sliding in the right-left direction relative to the base 80. The slider 70 is connected to the slider 66. However, the slider 70 is capable of sliding in the right-left direction relative to the slider 66 slightly. Near the right end of the slider 70, a hook 70*a* is provided.

The coil spring 68 is a compression coil spring located between the slider 66 and the slider 70. Accordingly, when the slider 70 slides rightward, the slider 66 is pressed by the coil spring 68 to slide rightward.

The coil spring 74 is a tension coil spring pulling the slider 70 leftward. A first end of the coil spring 74 is hooked by the hook 70*a*. A second end of the coil spring 74 is hooked by the hook 80*b*.

The lever 72 is a stick-like member extending in the front-rear direction and is capable of rotating relative to the sheet tray 16. More specifically, the rear end of the lever 72 is attached to the bottom surface 16*a* of the sheet tray 16, and the lever 72 is capable of rotating on the rear end. The front end of the lever 72 is connected to the slider 70. The slider 70 is, as mentioned above, pulled leftward by the coil spring 74. Accordingly, the coil spring 74 applies an elastic force to rotate the lever 72 clockwise when viewed from the top. When the lever 72 is rotated clockwise, the lever 72 protrudes leftward from the sheet tray 16. Thus, the coil spring 74 functions as an elastic member applying an elastic force to the lever 72 so as to keep the lever 72 protruding from the sheet tray 16.

Operation of the Sheet Feed Cassette

Next, the operation of the sheet feed cassette 15 is described with reference to the drawings. The sheet feed cassette 15 is capable of coming into four states, namely, a non-full-stacking attached state, a non-full-stacking detached state, a full-stacking detached state and a full-stacking attached state, as described below.

The non-full-stacking attached state is a state where the sheet feed cassette 15 is attached to the body 3 and supports a small number of sheets stacked therein. The non-full-stacking detached state is a state where the sheet feed cassette 15 is detached from the body 3 and supports a small number of sheets stacked therein. The full-staking detached state is a state where the sheet feed cassette 15 is detached from the body 3 and supports a large number of sheets stacked therein. The full-stacking attached state is a state where the sheet feed cassette 15 is attached to the body 3 and supports a large number of sheets stacked therein.

Figure 12:
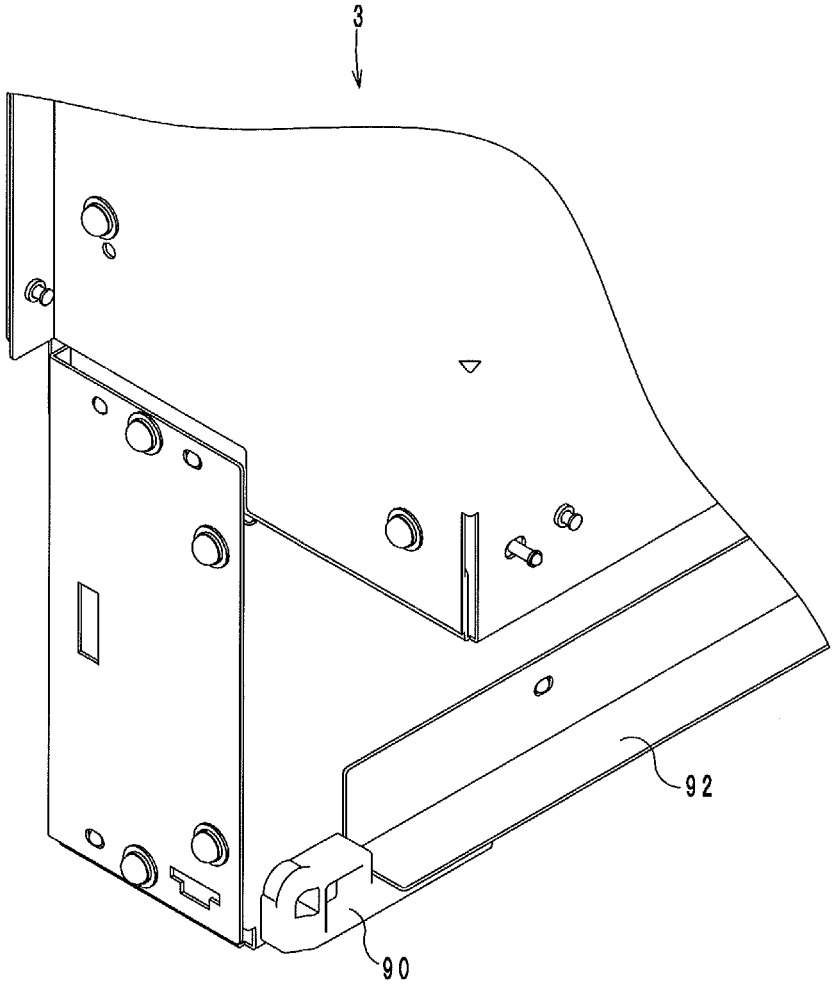
FIG. 12 is an enlarged view of a left portion of an opening made in a body of the image forming apparatus in which the sheet feed cassette is to be inserted.
Figure 13:
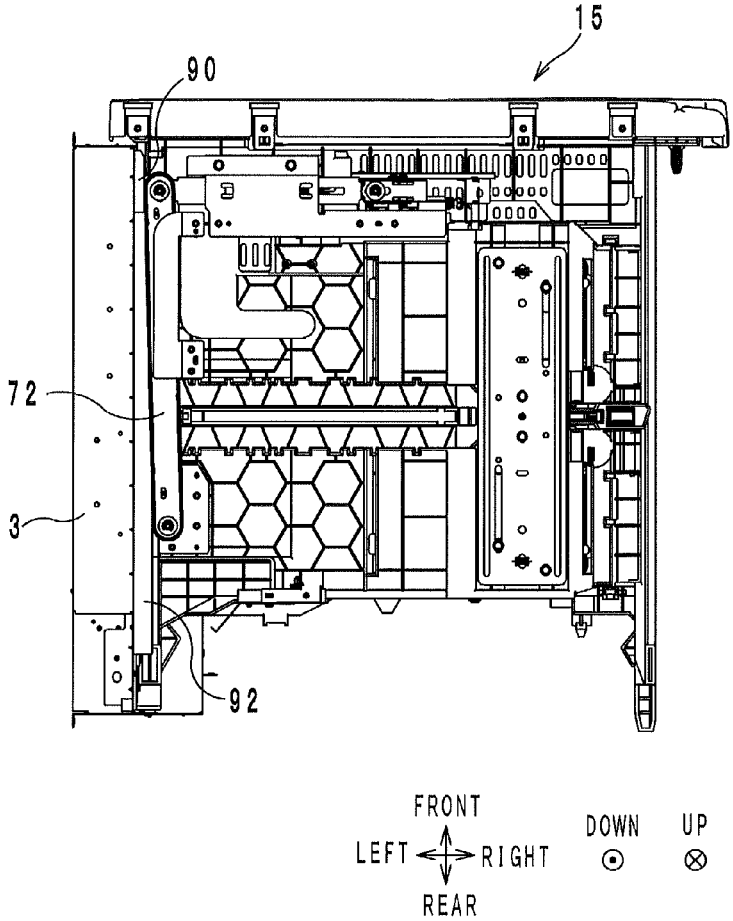
FIG. 13 is a bottom view of the sheet feed cassette set in the image forming apparatus.
Figure 14:
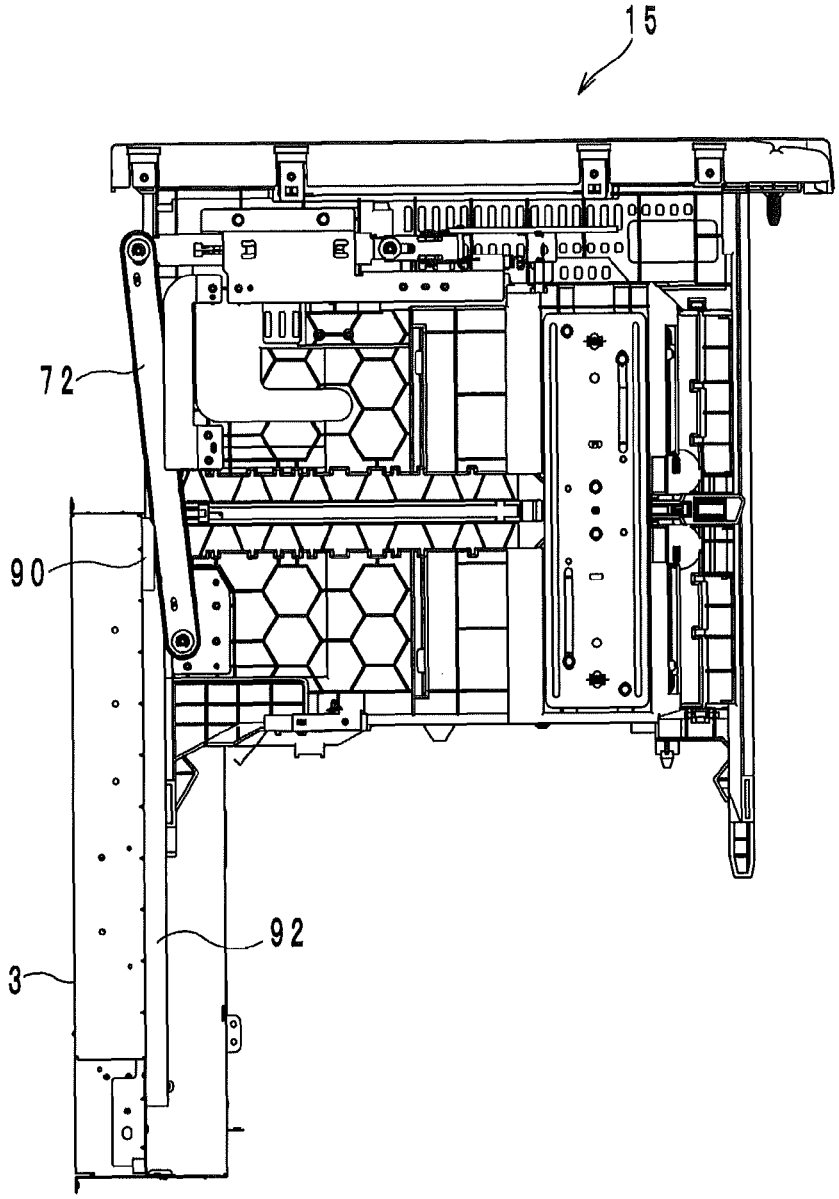
FIG. 14 is a bottom view of the sheet feed cassette in the middle of detachment from the body of the image forming apparatus.
Figure 15:
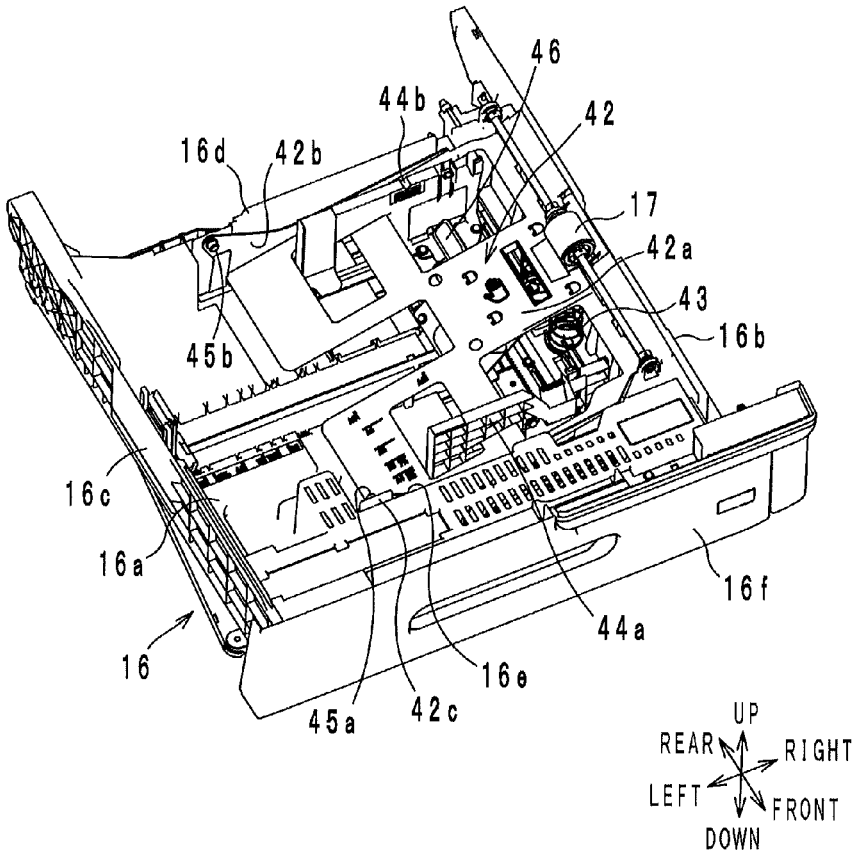
FIG. 15 is a perspective view of the sheet feed cassette in a non-full-stacking detached state.
Figure 16:
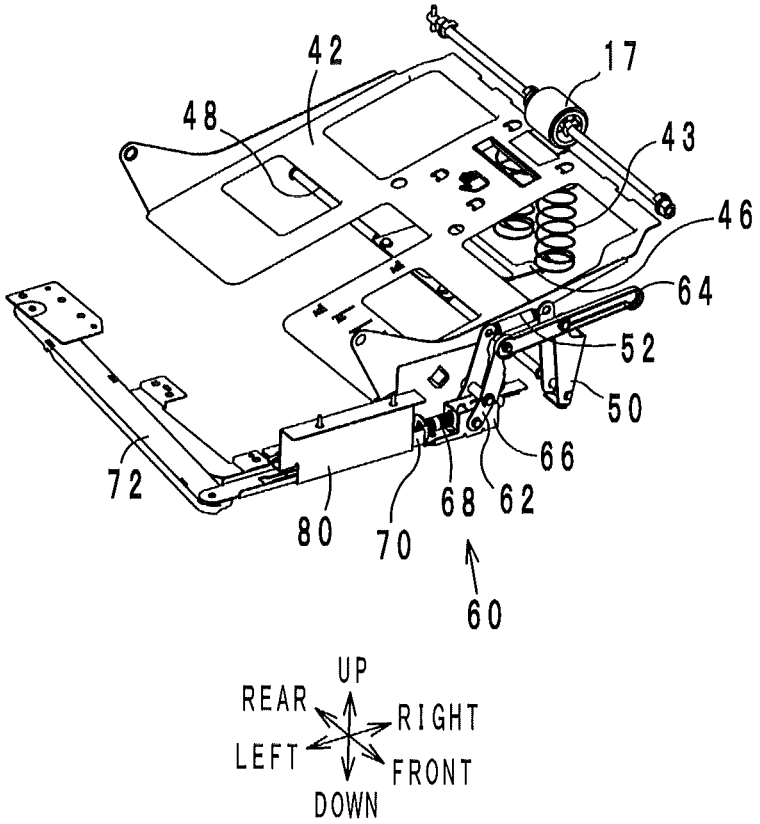
FIG. 16 is a perspective view of the sheet feed cassette in the non-full-stacking detached state with the sheet tray omitted.
Figure 17:
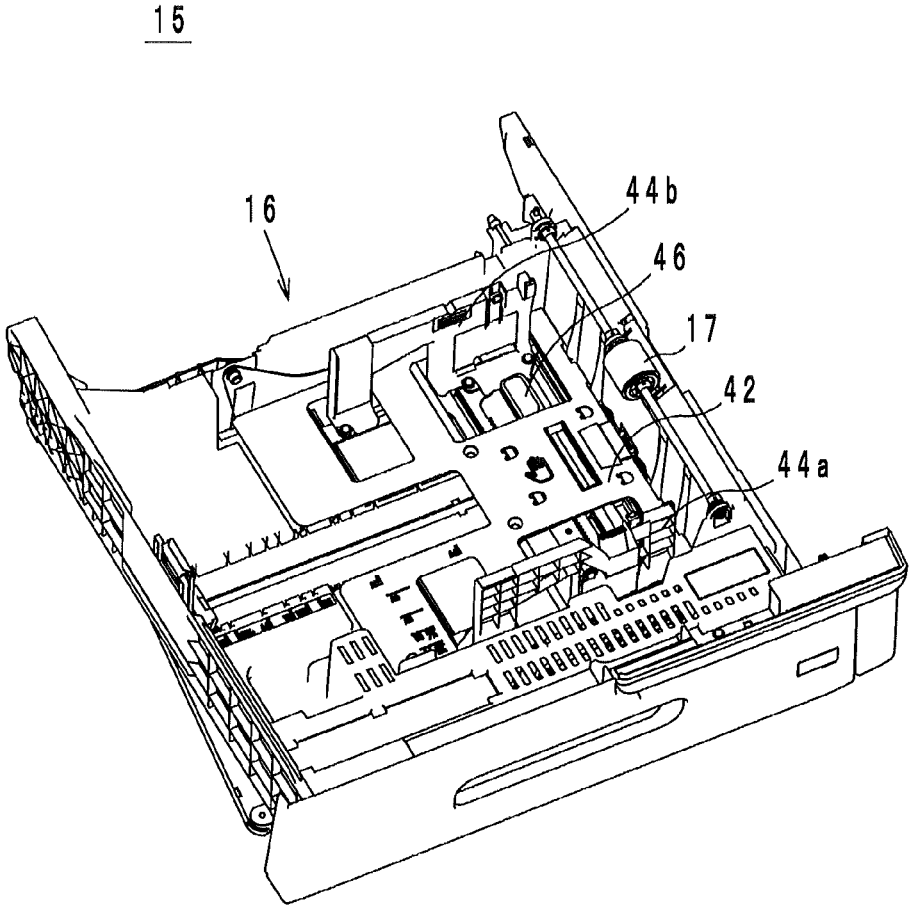
FIG. 17 is a perspective view of the sheet feed cassette in a full-stacking detached state.
Figure 18:
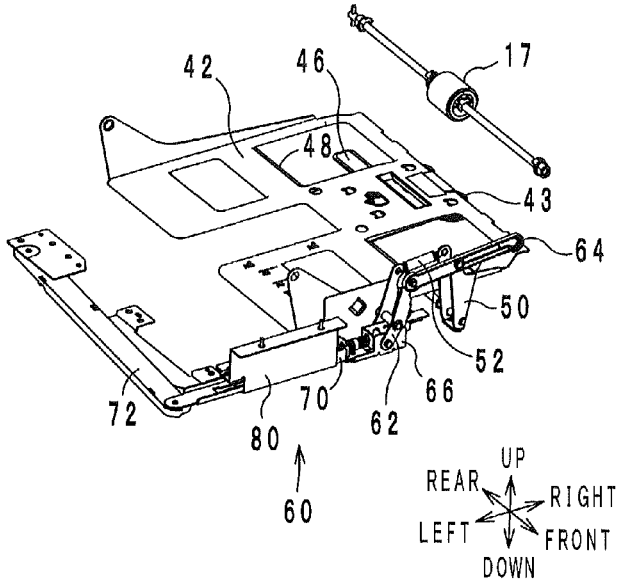
FIG. 18 is a perspective view of the sheet feed cassette in the full-stacking detached state with the sheet tray omitted.
Figure 19:
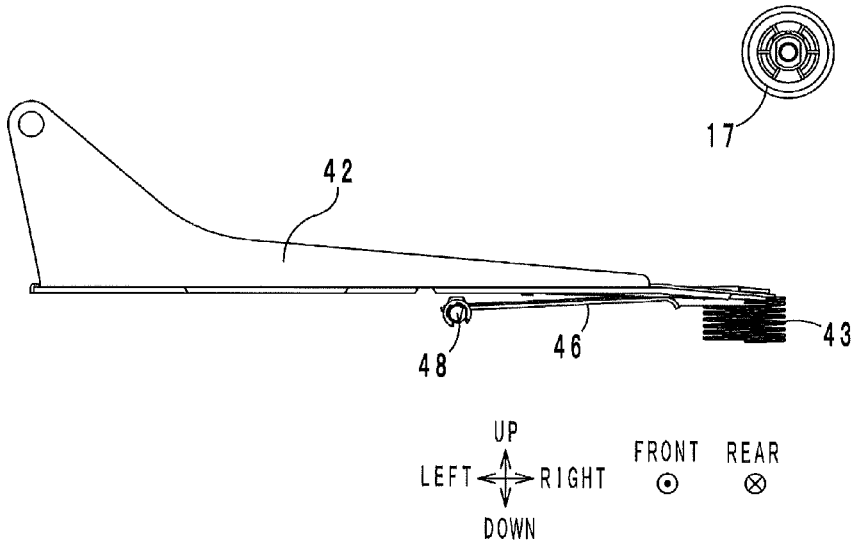
FIG. 19 is a front view of the press-up plate and the auxiliary press-up plate of the sheet feed cassette in the state shown by FIG. 18.
Figure 20:
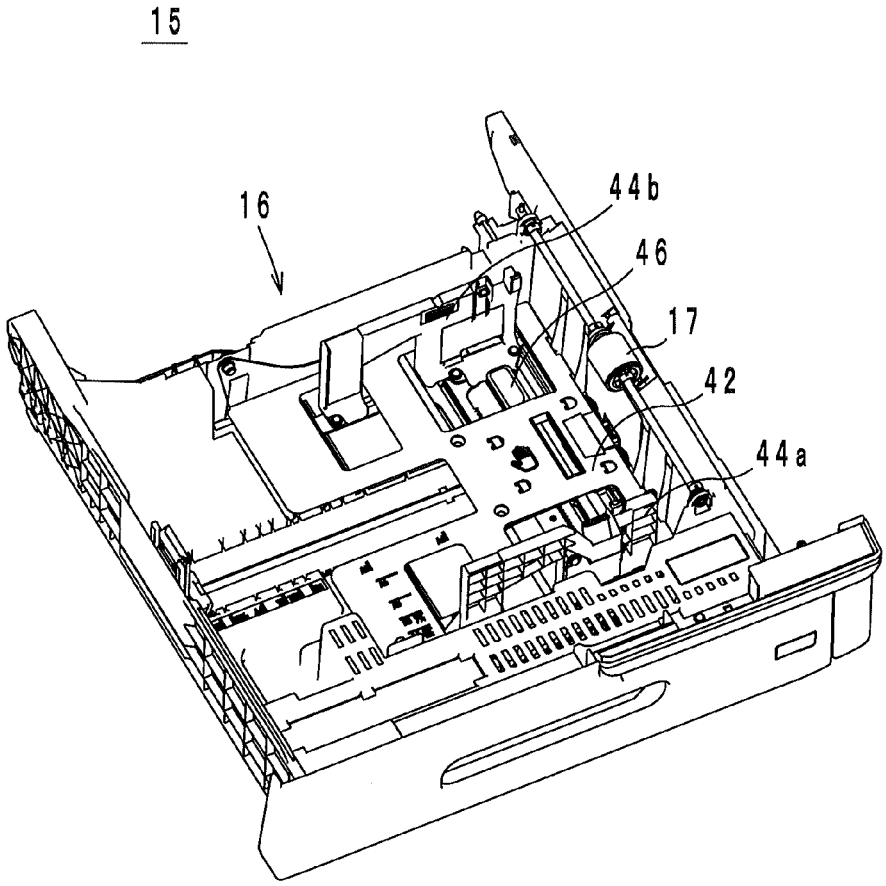
FIG. 20 is a perspective view of the sheet feed cassette in a full-stacking attached state.
Figure 21:
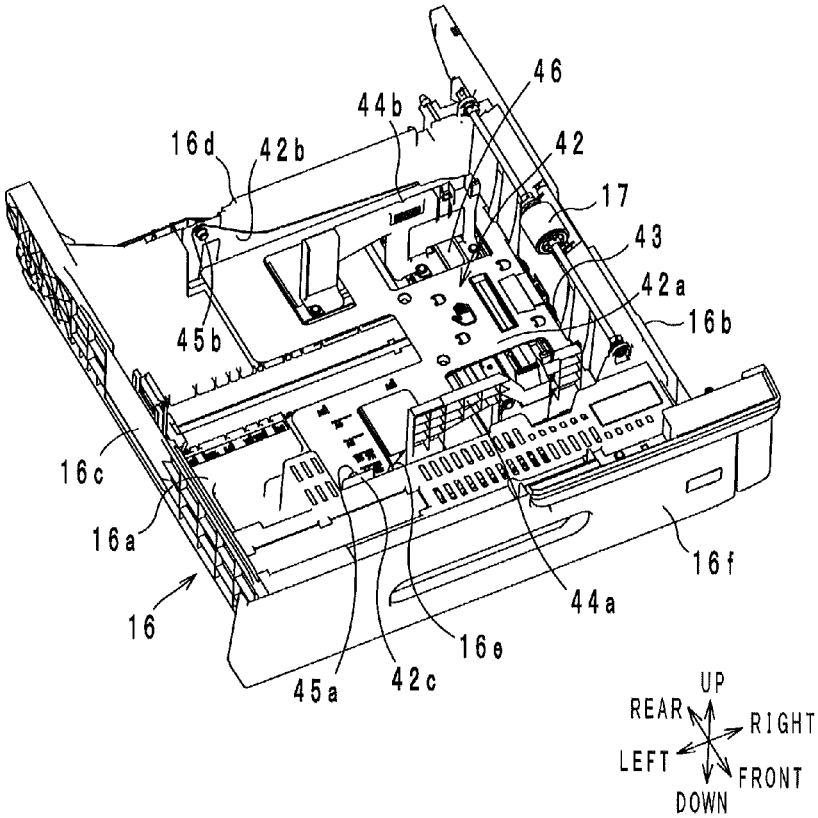
FIG. 21 is a perspective view of the sheet feed cassette in the full-stacking attached state.
Figure 22:
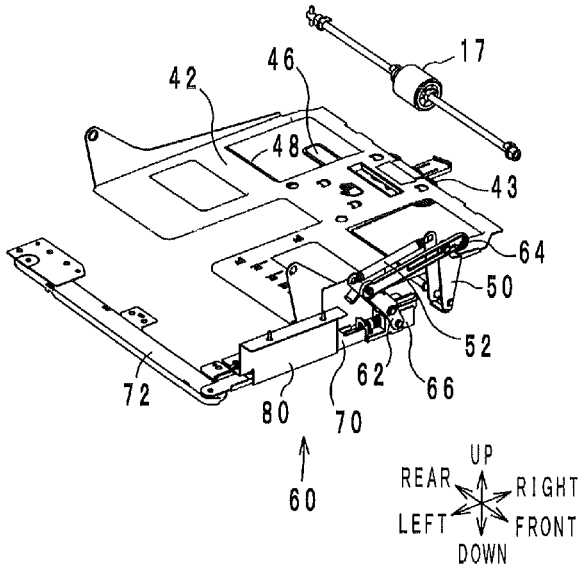
FIG. 22 is a perspective view of the sheet feed cassette in the full-stacking attached state with the sheet tray omitted.
Figure 23:
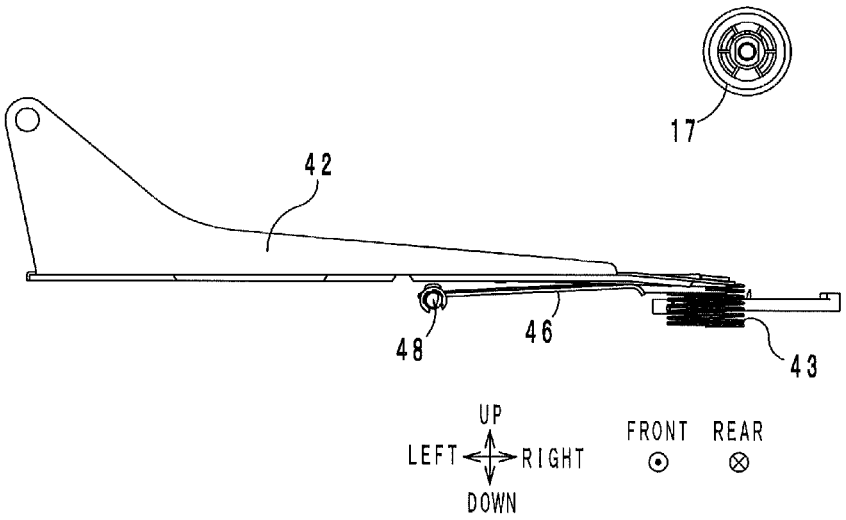
FIG. 23 is a front view of the press-up plate and the auxiliary press-up plate of the sheet feed cassette in the state shown by FIG. 22.

FIG. 12 is an enlarged view of a part near the left end of an opening made in the body 3 to permit setting of the sheet feed cassette 15 in the body 3. FIG. 13 is a bottom view of the sheet feed cassette 15 set in the body 3. FIG. 14 is a bottom view of the sheet feed cassette 15 in the middle of detachment from the body 3. FIG. 15 is a perspective view of the sheet feed cassette 15 in the non-full-stacking detached state. FIG. 16 is a perspective view of the sheet feed cassette 15 in the non-full-stacking detached state with the sheet tray 16 omitted. FIG. 17 is a perspective view of the sheet feed cassette 15 in the full-stacking detached state. FIG. 18 is a perspective view of the sheet feed cassette 15 in the full-stacking detached state with the sheet tray 16 omitted. FIG. 19 is a front view of the press-up plate 42 and the auxiliary press-up plate 46 of the sheet feed cassette 15 in the state shown by FIG. 18. FIGS. 20 and 21 are perspective views of the sheet feed cassette 15 in the full-stacking attached state. In the state shown by FIG. 20, sheets P having a relatively large width are stacked in the sheet feed cassette 15. In the state shown by FIG. 21, sheets P having a relatively small width are stacked in the sheet feed cassette 15. FIG. 22 is a perspective view of the sheet feed cassette 15 in the full-stacking attached state with the sheet tray 16 omitted. FIG. 23 is a front view of the press-up plate 42 and the auxiliary press-up plate 46 of the sheet feed cassette 15 in the state shown by FIG. 22.

First, the opening of the body 3 is described. As shown in FIG. 12, a contact member 90 is provided at the left end of the opening of the body 3. The contact member 90 is to come into contact with the lever 72 as described below, and the contact member 90 is, for example, made of resin. Behind the contact member 90, a rail 92 extending toward the rear side is provided. The rail 92 serves as a guide for smooth slide in the front-rear direction of the sheet feed cassette 15.

Next, the non-full-stacking attached state of the sheet feed cassette 15 is described. In the non-full-stacking attached state, only a small number of sheets P are stacked in the sheet feed cassette 15, and accordingly, the press-up plate 45 is pressed by the coil spring 43 as shown by FIGS. 4 and 5. In the non-full-stacking attached state, also, the sheet feed cassette 15 is set in the body 3. Therefore, the front end of the lever 72 is pushed by the contact member 90 of the body 3. Thereby, the lever 72 is rotated counterclockwise when viewed from the top, and does not protrude from the sheet tray 16. The lever 72 rotates counterclockwise, and the lever 72 pushes the slider 70 to slide rightward. Accordingly, the slider 66 is pressed by the slider 70 via the coil spring 68 to slide rightward. Thereby, the lever 62 is rotated counterclockwise. Consequently, the second end of the coil spring 52 is pulled leftward, and the elastic force generated by the coil spring 52 becomes greater. Then, the lever 50 is pulled counterclockwise by the coil spring 52. Accordingly, as shown by FIGS. 4 and 5, the auxiliary press-up plate 46 presses up the press-up plate 42. Thus, the sheets P are pressed up by the press-up plate 42 and the auxiliary press-up plate 46.

The non-full-stacking attached state has been described in connection with a case where sheets P having a relatively large width are stacked, with reference to FIGS. 4 and 5. However, there are cases where sheets P having a relatively small width are stacked. In such a case, the auxiliary press-up plate 46 is kept by the regulating member 44*b* as shown in FIGS. 9 and 11. Accordingly, the auxiliary press-up plate 46 does not press up the press-up plate 42. Therefore, the sheets P are pressed up by only the press-up plate 42.

Next, the non-full-stacking detached state is described. The sheet cassette 15 in the non-full-stacking attached state is drawn from the body 3 to the front, whereby the sheet cassette 15 comes into the non-full-stacking detached state. When the sheet cassette 15 in the non-full-stacking attached state is drawn from the body 3, the lever 72 and the contact member 90 come out of contact with each other. At this time, the coil spring 74 applies an elastic force to the lever 72 via the slider 70 so as to keep the lever 72 protruding from the sheet tray 16. Therefore, the slider 70 slides leftward, and the lever 72 is rotated clockwise to protrude from the sheet tray 16 when viewed from the top. Together with the leftward slide of the slider 70, the slider 66 is pulled to slide leftward. Thereby, the lever 62 is rotated clockwise. Consequently, the second end of the coil spring 52 is pushed rightward, and the elastic force generated by the coil spring 52 becomes smaller. Then, the lever 50 is pushed rightward by the link 64 to rotate clockwise. Consequently, as shown in FIGS. 15 and 16, the auxiliary press-up plate 46 rotates clockwise and separates from the press-up plate 42. Therefore, the sheets P are pressed up by only the press-up plate 42.

As described above, the regulatory mechanism 60 operates the lever 50 such that the elastic force generated by the coil spring 52 in the non-full-stacking detached state is smaller than the elastic force generated by the coil spring 52 in the non-full-stacking attached state. Therefore, it never happens that the auxiliary press-up plate 46 presses up the press-up plate 42 in the non-full-stacking detached state.

Next, the full-stacking detached state is described. A large number of sheets P are stacked in the sheet cassette 15 in the non-full-stacking detached state until the press-up plate 42 is pushed down, whereby the sheet cassette 15 comes into the full-stacking detached state as shown by FIGS. 17 through 19. In the non-full-stacking detached state, the auxiliary press-up plate 46 is kept lying down. Therefore, even when the sheet cassette 15 changes from the non-full-stacking detached state to the full-stacking detached state, the position of the auxiliary press-up state 46 does not change, that is, the regulatory mechanism 60 does not operate.

Next, the full-stacking detached state is described. The sheet cassette in the full-stacking detached state is set in the body 3, whereby the sheet cassette 15 comes into the full-stacking attached state. More specifically, when the sheet feed cassette 15 is set in the body 3, as shown in FIG. 13, the front end of the lever 72 is pushed by the contact member 90 of the body 3. Thereby, the lever 72 is rotated counterclockwise when viewed from the top and does not protrude from the sheet tray 16. Together with the counterclockwise rotation of the lever 72, the slider 70 is pushed by the lever 72 to slide rightward. Accordingly, the slider 66 is pushed by the slider 70 via the coil spring 68 to slide rightward. Thereby, the lever 62 is rotated counterclockwise. Consequently, the second end of the coil spring 52 is pulled leftward, and the elastic force generated by the coil spring 52 becomes greater. Then, the lever 50 is pulled counterclockwise by the coil spring 52. Consequently, as shown in FIGS. 20, 22 and 23, the auxiliary press-up plate 46 presses up the press-up plate 42. Thereby, the sheets P are pressed up by the press-up plate 42 and the auxiliary press-up plate 46. Further, as the number of sheets P on the press-up plate 42 is decreasing, the press-up plate 42 and the auxiliary press-up plate 46 are rising.

The full-stacking attached state has been described in connection with a case where sheets having a relatively large width are stacked, with reference to FIG. 20. However, there are also cases where sheets P having a relatively small width are stacked. In such a case, the auxiliary press-up plate 46 is kept by the regulating member 44*b* as shown in FIG. 21. Therefore, the auxiliary press-up plate 46 does not press up the press-up plate 42. Accordingly, the sheets P are pressed up by only the press-up plate 46.

Advantageous Effects

In the sheet cassette 15 of the structure above, the press-up plate 42 can be pressed down only by a small force. More specifically, in setting a large number of sheets in the automatic document feeder disclosed by Japanese Patent Laid-Open Publication No. H11-116073, it is necessary to press down the stacker plate after setting sheets on the stacker plate. In the automatic document feeder, when heavy sheets are stacked, the stacker plate is pressed up by the auxiliary press-up plate. In this case, therefore, it is necessary to press down the stacker plate against the elastic force generated by the first coil and the second coil. Hence, in setting sheets in the automatic document feeder disclosed by Japanese Patent Laid- Open Publication No. H11-116073, a great force is necessary to press down the stacker plate.

In the sheet feed cassette 15, on the other hand, the regulatory mechanism 60 operates such that the auxiliary press-up plate 46 does not press up the press-up plate 42 when the sheet tray 16 is detached from the body 3 (in the non-full-stacking detached state). Therefore, when a user presses down the press-up plate 42 to change the sheet feed cassette 15 from the non-full-stacking detached state to the full-stacking detached state, it is necessary to press down the press-up plate 42 only against the elastic force of the coil spring 43 without resisting against the elastic force of the coil spring 52. In the sheet feed cassette 15, therefore, only a smaller force is necessary to press down the press-up plate 42. Accordingly, the handling of the sheet feed cassette 15 is easier, and the impact noise generated by the press-down of the press-up plate 42 can be reduced.

The link 64 restricts movements of the levers 50 and 62 such that the portion of the lever 50 where the first end of the coil spring 52 is connected (the upper end of the plate 50*a*) and the portion of the lever 62 where the second end of the coil spring 52 is connected (the upper end of the plate 62*a*) does not come within a specified distance (natural length of the coil spring 52). This prevents the lever 50 and the lever 60 from coming too close to each other, thereby preventing the coil spring 52 from bending.

Also, the design of the sheet cassette 15 is easy. Specifically, in the non-full-stacking attached state, the lever 62 is rotated counterclockwise together with counterclockwise rotation of the lever 72. It is preferred to design the sheet cassette 15 such that the start of rotation of the lever 72 and the start of rotation of the lever 62 are synchronized with each other and that the stop of rotation of the lever 72 and the stop of rotation of the lever 62 are synchronized with each other. However, in a case where the sheet cassette 15 is designed in this manner, the rotation of the lever 62 together with the rotation of the lever 72 may be too much or too little due to a production tolerance or the like. When the lever 62 rotates too much, the coil spring 52 will have too heavy a load. When the lever 62 rotates too little, the auxiliary press-up plate 46 will not lie down enough.

In the sheet feed cassette 15, in order to prevent too much rotation of the lever 62, the projection 80*c* is provided on the left side of the lever 62. Thereby, while the lever 72 is rotated counterclockwise, the lever 62 comes in contact with the projection 80*c* and stops. Thus, the projection 80*c* serves as a stopper that prevents the lever 62 from rotating too much in the direction to increase the elastic force generated by the coil spring 52 (in the counterclockwise direction). In this way, too much rotation of the lever 62 can be prevented, and consequently, too much stretch of the coil spring 52 can be prevented.

In order to prevent too little rotation of the lever 62, the coil spring 68 is provided. The coil spring 68 is located between the lever 62 and the lever 72, and more specifically, between the slider 66 and the slider 70. The sheet cassette 15 is designed such that the time when the lever 62 comes in contact with the projection 80*c* and stops is earlier than the time when the lever 72 stops rotating. In other words, after the lever 62 comes in contact with the projection 80*c* and stops, the lever 72 is pressed by the contact member 90 to rotate further. Thereby, the slider 70 is moved rightward, and the coil spring 68 is compressed (elastically deformed). Thus, the movement of the lever 72 is absorbed by the coil spring 68. With this arrangement, the lever 62 certainly rotates until it comes in contact with the projection 80*c*, and inadequate lying of the auxiliary press-up plate 46 due to too little rotation of the lever 62 can be prevented.

As described above, in the sheet feed cassette 15, since the coil spring 68 and the projection 80*c* are provided, only by designing the sheet cassette 15 such that the time when the lever 62 comes in contact with the projection 80*c* and stops is earlier than the time when the lever 72 stops rotating, the amount of rotation of the lever 62 can be set properly. Therefore, it is not necessary to design the sheet feed cassette 15 such that the start of rotation of the lever 72 and the start of rotation of the lever 62 are synchronized with each other and that the stop of rotation of the lever 72 and the stop of rotation of the lever 62 are synchronized with each other. Thus, the design of the sheet feed cassette 15 is easy.

Other Embodiments

Sheet feed cassettes according to the present invention are not limited to the sheet feed cassette 15 described above.

In the embodiment above, the auxiliary press-up plate 46 presses up the press-up plate 42. However, the auxiliary press-up plate 46 may be a member pressing up the sheets P directly.

It is possible to replace the coil springs 43, 52, 68 and 74 with other elastic members such as rubber members.

Although the present invention has been described in connection with the preferred embodiments above, various changes and modifications may be apparent to those who are skilled in the art. Such changes and modifications are to be understood as being within the scope of the invention.

What is claimed is:

1. A sheet feed cassette comprising:

a main body to be set in a body of an image forming apparatus;

a first press-up member provided on a bottom surface of the main body and configured to support a plurality of print media stacked thereon;

a first elastic member configured to apply an elastic force to the first press-up member such that the first press-up member presses up a downstream end, with respect to a feeding direction, of the plurality of print media;

a second press-up member;

a second elastic member configured to apply an elastic force to the second press-up member such that the second press-up member presses up the first press-up member or the plurality of print media;

an adjusting mechanism configured to adjust the force of the second press-up member to press up the first press-up member or the plurality of print media in accordance with a size of the print media; and a regulatory mechanism configured to prevent the second press-up member from pressing up the first press-up member or the plurality of print media when the main body is detached from the body of the image forming apparatus.

2. The sheet feed cassette according to claim 1, wherein, when the plurality of print media stacked on the first press-up member have a relatively small size, the force of the second press-up member to press up the first press-up member or the plurality of print media is relatively small; and wherein, when the plurality of print media stacked on the first press-up member have a relatively large size, the force of the second press-up member to press up the first press-up member or the plurality of print media is relatively great.

3. The sheet feed cassette according to claim 1, wherein the size of the plurality of print media means a width, which is a size in a direction perpendicular to the feeding direction, of the plurality of print media.

4. The sheet feed cassette according to claim 1, further comprising:

a central shaft extending in a print-media widthwise direction perpendicular to the feeding direction and supporting the second press-up member such that the second press-up member is capable of rotating on the central shaft; and a first lever to which a first end of the second elastic member is connected, the first lever being supported by the central shaft so as to be capable of rotating on the central shaft;

wherein the regulatory mechanism includes a second lever to which a second end of the second elastic member is connected, the second lever being supported by the main body so as to be capable of rotating on the main body; and wherein, the regulatory mechanism operates the second lever such that the elastic force generated by the second elastic member in a first state where the main body is detached from the body of the image forming apparatus is smaller than the elastic force generated by the second elastic member in a second state where the main body is set in the body of the image forming apparatus.

5. The sheet feed cassette according to claim 4, wherein the second elastic member is a tension spring; and wherein the regulatory mechanism further includes a restricting member configured to restrict movements of the first lever and the second lever such that a portion of the first lever where the first end of the second elastic member is connected and a portion of the second lever where the second end of the second elastic member is connected does not come within a specified distance.

6. The sheet feed cassette according to claim 4, wherein the second elastic member is a tension spring; and wherein the regulatory mechanism further includes a stopper configured to prevent the second, lever from rotating in a direction to increase the elastic force in the second state.

7. The sheet feed cassette according to claim 6, wherein the regulatory mechanism further includes:

a third lever supported by the main body so as to be capable of rotating on the main body; and a third elastic member configured to apply an elastic force to the third lever so as to keep the third lever protruding from the main body;

wherein, in the first state, the third lever protrudes from the main body, thereby decreasing the elastic force generated by the second elastic member;

wherein, in the second state, the third lever is pushed by the body of the image forming apparatus to rotate, thereby causing the second lever to rotate, thereby increasing the elastic force generated by the second elastic member.

8. The sheet feed cassette according to claim 7, wherein the regulatory mechanism further includes:

a fourth elastic member located between the third lever and the fourth lever;

wherein, during a change from the first state to the second state, the second lever comes in contact with the stopper, and thereafter the third lever is pushed further by the body of the image forming apparatus, whereby the fourth elastic member is elastically deformed.

* * * * *